US005405132A

United States Patent [19]

St. Onge

[11] Patent Number: 5,405,132

[45] Date of Patent: Apr. 11, 1995

[54] TRANSPORTABLE BASKETBALL NET ASSEMBLY FOR TEMPORARY USE ON A BASKETBALL RIM

[76] Inventor: Matthew R. St. Onge, 6-12 Louisburg Sq., Nashua, N.H. 03060

[21] Appl. No.: 218,310

[22] Filed: Mar. 25, 1994

[51] Int. Cl.[6] ..... A63B 63/08

[52] U.S. Cl. ..... 273/1.5 R

[58] Field of Search ..... 273/1.5 R, 1.5 A

[56] References Cited

U.S. PATENT DOCUMENTS

| | | | |
|---|---|---|---|
| 4,082,269 | 4/1978 | Hill | 273/1.5 R |
| 4,805,903 | 2/1989 | McArdle | 273/1.5 R |
| 4,834,368 | 5/1989 | Qualley | 273/1.5 R |
| 4,903,964 | 2/1990 | Anderson | 273/1.5 R |
| 4,905,995 | 3/1990 | Apo | 273/1.5 R |
| 5,098,091 | 3/1992 | McGnern | 273/1.5 R |
| 5,123,642 | 6/1992 | Stokes | 273/1.5 R |
| 5,195,742 | 3/1993 | Bailey | 273/1.5 R |

*Primary Examiner*—Paul E. Shapiro

*Attorney, Agent, or Firm*—Daniel J. Bourque; Michael J. Bujold; Anthony G. M. Davis

[57] ABSTRACT

A transportable basketball net assembly for temporary use on a basketball rim, installed from the ground using only the basketball. Installation is accomplished by closing temporarily the bottom of the net by use of a clip or equivalent means secured to the net, then inverting and disposing the net assembly over the basketball, then throwing the ball and net assembly into position on the basketball rim, the clip or equivalent releasing under the force and weight of the falling ball, thus opening the net. The net assembly is dislodged and removed by throwing the ball up through the rim, contacting the net and the flanged collar with upward force from below.

20 Claims, 6 Drawing Sheets

TRANSPORTABLE BASKETBALL NET ASSEMBLY FOR TEMPORARY USE ON A BASKETBALL RIM

BACKGROUND OF THE INVENTION

FIELD OF THE INVENTION

This invention most generally relates to games and other activities employing netted hoops or netted rims or other netted openings through or into which balls or other objects are dropped, thrown or otherwise passed.

More specifically, it relates to the sport of basketball and to the basketball goal assembly. The goal assembly is a backboard mounted in a vertical plane high over the basketball court to which a circular rim of approximately twice the diameter of a basketball is firmly attached in a horizontal plane. At evenly spaced intervals around the rim, the large open end of a net is attached, the net having a smaller opposite open end through which a basketball may readily pass. The rim and net assembly is often referred to as a "hoop." The object of the game, in the general sense, is to throw, drop or otherwise pass the basketball down through the hoop.

It is commonly known to affectionados of the sport that a hoop or rim without a net does not affect the motion of the basketball in the same manor as a hoop or rim with a net. Likewise, a hoop or rim with a torn or damaged net does not affect the motion of the basketball in the desired manner. It is very important to the players and spectators, then, that the hoop or rim be properly equipped with a net in good condition. Is incumbent upon managers of such facilities to make it so, and keep it so, if their goal is to attract users and spectators to the facility.

The conventional basketball rim is made of metal. The conventional means of attaching a net to the rim is by means of twelve wire loops uniformally positioned and welded to the lower edge of the rim. The rim is generally permanently installed about ten feet above the floor of the basketball court, making it inconvenient, time-consuming, difficult, and potentially dangerous to install or change a net. It is therefore properly and commonly the province of the facilities manager to maintain the court, including the net, and to have and use the ladders and other necessary tools required to do so. It is equally common that new nets and the necessary tools to install it will be secured and unavailable for immediate access by most casual users and potential users of the basketball court.

It is the further misfortune of these casual users and potential users that the basketball net, once installed, is then often neglected for an extended period when a net is worn, damaged or missing, until the facilities manager is faced with a compelling reason to replace it. In public-use installations, vandalism may be a further factor in the frequency of damaged and missing nets. On outdoor courts, the weather is a further major factor in the deterioration of basketball nets. The result is that many courts are left only marginally attractive for the playing of basketball due to the worn, damaged, or missing net problem.

DESCRIPTION OF THE PRIOR ART

This problem has led to the invention of basketball net assemblies using alternative schemes and means which can conceptually be readily installed, removed and stored for reinstallation when later required.

Qualley's U.S. Pat. No. 4,834,368, May 30, 1989, teaches a modification to the conventional net to add a flexible collar to the large end of the net, which collar, when properly oriented and installed, embraces the rim circumference and is folded over on itself and secured by sections of hook-and-eye fabric tape material. There may be significant cost to such a complex net, its appearance is unaesthetic as to a conventional net, there is the necessity for a ladder or other means to access the rim for installation and removal, and there is significant time required for the manipulation of the net assembly for installation and removal, all of which burden the utility and value of Qualley's invention for many individual users.

McGivern's U.S. Pat. No. 5,098,091, Mar. 24, 1992, teaches the use of a supplemental rim to which the net is attached, the supplemental rim then being suspended under the primary rim by means of six quick disconnect straps or fasteners which are folded over the primary rim and secured then to themselves. As with Qualley's invention, there may be significant cost to such a complex net assembly, its appearance is unaesthetic as to a conventional net, there is the necessity for a ladder or other means to access the rim for installation and removal, and there is significant time required for the manipulation of the ladder and net assembly for installation and removal, all of which burden the utility and value of McGivern's invention for many individual users.

Anderson's U.S. Pat. No. 4,903,964, Feb. 27, 1990, teaches the use of an annular, inverted, channel-shaped, rim-engaging device with slots on the lower periphery to which a net is attached. The device is lifted into position, rotationally oriented to account for the rim support, and pulled down into a pressfit engagement with the rim by use of a long lifting tool with a hook-shaped end. There may be significant cost to such a complex net assembly, there is the necessity for a long lifting tool with a hook-shaped end for installation and removal, and there is significant time required to acquire and use such a tool for installation and removal of the net assembly, all of which burden the utility and value of Anderson's invention for many individual users.

McArdle's U.S. Pat. No. 4,805,903, Feb. 21, 1989, teaches the use of a circular skirt that fits just inside the basketball rim, with an outwardly-rolled upper edge with a magnetic strip that secures it, when properly rotationally oriented for the rim support, around the top edge of the rim, a net being fastened to the lower edge of the circular skirt, and a boat hook being required to install and remove the device from the basketball rim. There is the necessity for use of a long lifting tool with a hook-shaped end for installation and removal, and there is significant time required to acquire and use such a tool for installation and removal of the net assembly, all of which burden the utility and value of McArdle's invention for many individual users.

Apo's U.S. Pat. No. 4,905,995, Mar. 6, 1990, teaches the use of a two-inch wide circular collar having an approximately ninety (90) degree outwardly-rolled flange on the upper end to rest on the top inner half of a basketball rim, and a net attached to the lower end of the collar, with the use of a long pole with protruding pins for installation and removal of the collar from the rim. There is here the necessity for a long lifting tool with protruding pins for installation and removal, there is significant time required to acquire and use such a tool for installation and removal of the net assembly, and the appearance of a two (2) inch long collar below the rim is unaesthetic as to a conventional net, all of which burden the utility and value of Apo's invention for many individual users. Apo's disclosure does, however, teach the useful idea of dislodging and recovering a net assembly by throwing a basketball up diagonally through the hoop to contact the net and lift the collar out of its seat on the rim.

The basic problem, not raised, not addressed, and not answered by the prior art, is the individual user's need for a personal solution to the problem of how to provide a transportable, quickly and easily installed and removed, aesthetically pleasing, functionally useful, temporary replacement for a worn, damaged, or missing basketball net, without the need for ladders or special tools or access to the same.

SUMMARY OF THE INVENTION

The purpose of the invention is to solve the individual user's problem of how to provide a quickly and easily installed and removed, aesthetically pleasing, functionally useful, temporary replacement for a worn, damaged, or missing basketball net, without the need for ladders or special tools or access to the same.

The apparatus of the present invention in its simplest form is expected to be user-owned and is a transportable basketball net assembly that can be easily assembled and transported by the user to any court and, in accordance with the method of the invention, draped over a basketball and thrown up into position on the rim, transforming the rim temporarily into a fully functional basketball goal. Afterwards, the net assembly can be knocked down with the basketball, and taken home by the user-owner.

A necessary object of the invention is that it be a functional substitute for a conventional basket ball net properly installed on a common basketball rim. To that end, the net assembly of the invention utilizes a conventional basketball net which will interact with the basketball in the familiar fashion when installed on a common basketball rim.

A primary object of the invention is that it be easily assemblable prior to use, without tools, if not already assembled at purchase. The net assembly is composed of only three principle parts; a flanged collar, a net, and a means for temporarily closing the small end of the net, such as small clips as in the preferred embodiment, or similarly unobtrusive means such as small VELCRO® brand or equivalent fastening tape tabs or snap tabs that remain attached to the net for convenience. The net assembly is easily assembled by hand before the first use, by assembling the net to the flanged collar and the clips to the net, and remains permanently assembled after that. It is equally easy, if ever required, to change a net by the same general process.

Another primary object of the invention is that it be easily transportable for users including pedestrians. The net assembly remains assembled, after initial assembly, and compacts to approximately the size of a pizza box. It is not heavy, and requires no accessory tools to be transported with it.

A further primary object of the invention is that it be durable, unbreakable and long-lasting. The flanged collar of the preferred embodiment is molded of durable, unbreakable plastic, and should stand up indefinitely to normal use. A conventional nylon basketball net will likely last far longer as part of a personally-owned, transportable net assembly than as a naked net in a permanent public, perhaps outdoor, installation.

A yet further primary object of the invention is that it be aesthetically acceptable to a majority of users. The flanged collar is short in height, due in part to the net being attached to the flange rather than the lower end of the collar as illustrated by some prior art, and it has no conspicuous attachment devices. It simply sits in place on the rim, and so is not aesthetically objectionable due to an extended collar or highly visible attaching means.

A still yet further primary object of the invention is that it be configured with easily engaged and effective net attachment means that provides effective strain relief to net's attach-loop lines. The slots of the invention may simply be radially oriented slits on the outer perimeter of the flange onto which the attach-loops are hooked. The flanged collar of the preferred embodiment is configured with U-shaped slots, which are oriented with the open end directed towards the center of the flange, to which the attach-loops of the net are simply attached from above the flange as to tabs. The net is then dropped through the collar and arranged so that the attach-loop lines of the net traverse, hang across, and are supported by the uniform radius or shoulder of the transition between the flange portion and the collar portion of the flanged collar. The uniform radius or shoulder provides a degree of strain relief to the attach-loops and slots.

Optionally, holes may be provided in the flange near the slots, down through which the attach loops are passed and then hooked into the slots from below. This provides additional security and strain relief to the overall arrangement.

A principal object of the invention is that it be uniformally circular with no need to be rotationally oriented for proper placement on the rim, as is common to some of the prior art. Since the flange of the flanged collar rests flat atop the rim, the collar being contained within the rim opening, the net attached to the top of the flange and disposed over the uniform radius or shoulder and down the inner wall of the collar, there is no protruding element to interfere with conventional rim support structure. Hence there is no rotational orientation requirement for the net assembly of this invention.

Another principal object of the invention is that it have an upper surface texture conducive to positive contact and good interaction with a moving basketball. To this end, the upper surface of the flange of the flanged collar, where it will most often and most likely contact the moving basketball, may be configured with a grainy, textured finish, rather than the smooth, slippery finish commonly achievable with items of molded manufacture.

A further principal object of the invention is that it have an underside surface texture conducive to a firm, non-bouncing, nonsliding contact with the rim. To this end, all or any or portions of the surfaces of the flanged collar likely to be in contact with the rim, when properly installed, may be configured with a layer of thin foam or rubber or other resilient, non-slip, slightly compressible, gripping sort of padding. The underside surfaces of the flanged collar likely to be in contact with the rim include the lower surface or underside of the flange, the inside surface of the uniform radius or shoulder, and the outside surface of the collar.

A yet further principal object of the invention is that it be easily manufacturable at low cost. The simplicity of the flanged collar lends itself to manufacture as a one-piece molded item. The balance of the net assembly is simple and inexpensive. There are no special accessories required.

A still yet further principal object of the invention is that it have a quick and simple means for installation and removal that requires no ladders or special tools, none of the risk associated with ladders or special tools, and no additional people. To this end, the net assembly is equipped with clips or other means for temporarily closing the small end of the net enough to prevent the free passage of a basketball. The clips when clipped to adjacent lines have a sufficiently strong grip to withstand the weight of the net assembly when it is inverted and disposed over a basketball and thrown up with the basketball into position on the rim.

The grip of the clips, however, is not strong enough to withstand the downward force and weight of the basketball as it falls on through the rim. When the flanged collar lodges into position and is supported by the rim, the falling ball disengages the clips, opening the net, and falling on through. The net is then in condition for normal operation. When the activity is over, the net assembly is easily removed and recovered by throwing the ball diagonally up through the hoop, contacting the net or the edge of the flanged collar or both, dislodging the net assembly to fall to the waiting owner below.

DESCRIPTION OF THE PREFERRED EMBODIMENT

Figure 1:
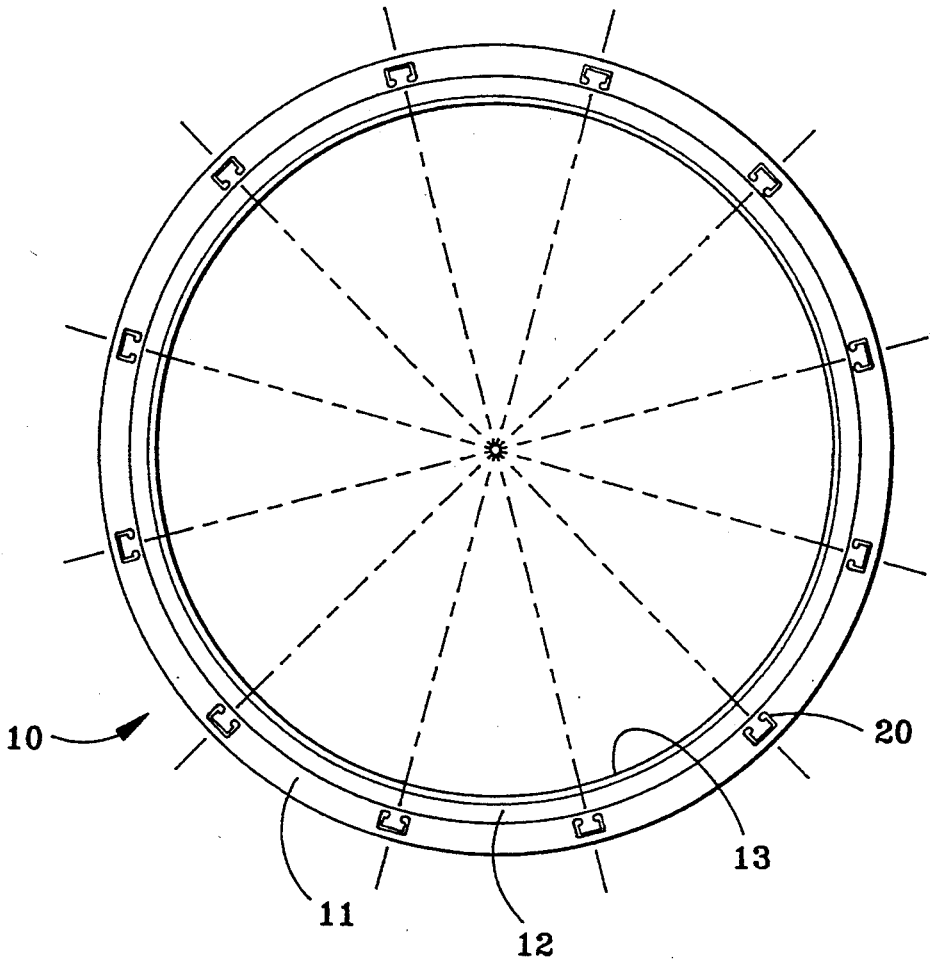
FIG. 1 is a top view of the preferred embodiment of the flanged collar of the net assembly, illustrating the U-shaped slots uniformally spaced around the circumference on the flange of the flanged collar, to which the attach-loops of the basketball net are attached.
Figure 2:
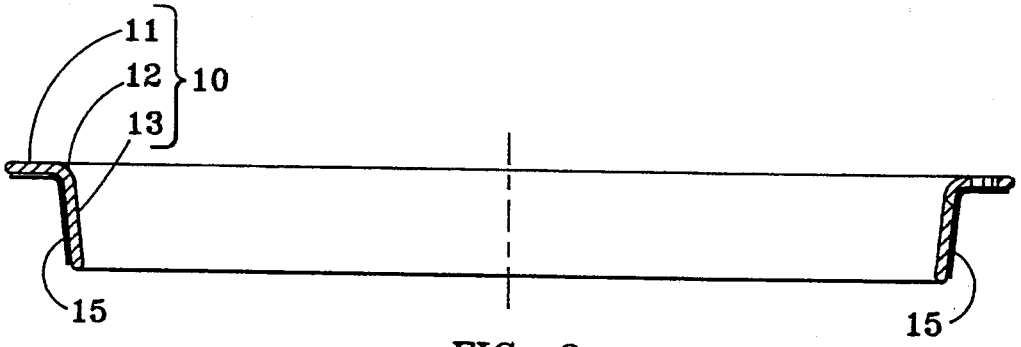
FIG. 2 is a cross-sectional side view of the flanged collar of the net assembly, illustrating the transition, via the uniform radius or shoulder, of the flange into the collar, and a resilient, slightly compressible pad on the surface normally in contact with the basketball rim.
Figure 3:
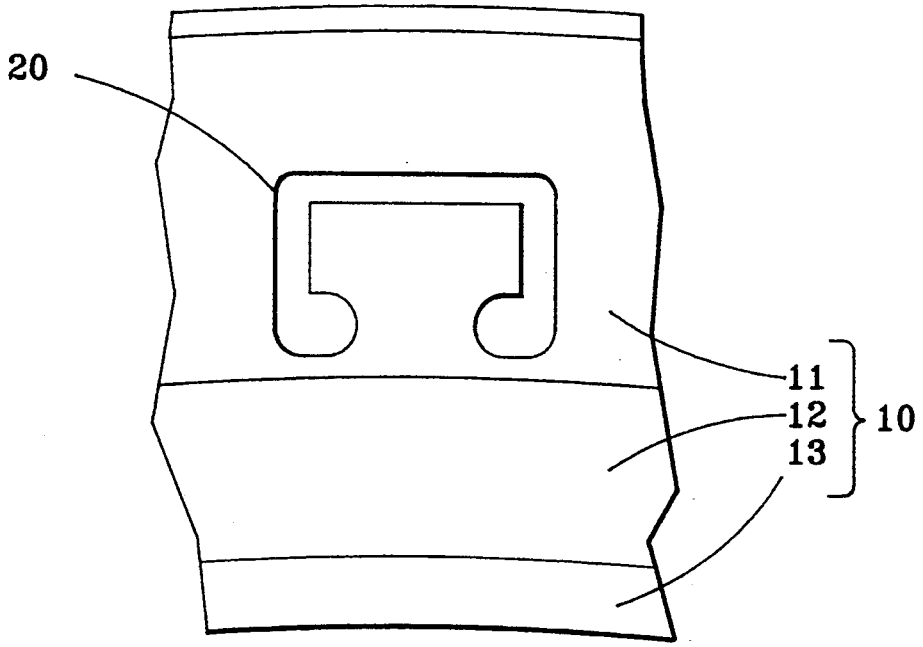
FIG. 3 is a fragmented top view of the preferred embodiment of the flanged collar, illustrating a U-shaped slot to which an attach-loop of the net is attachable as to a tab.
Figure 4:
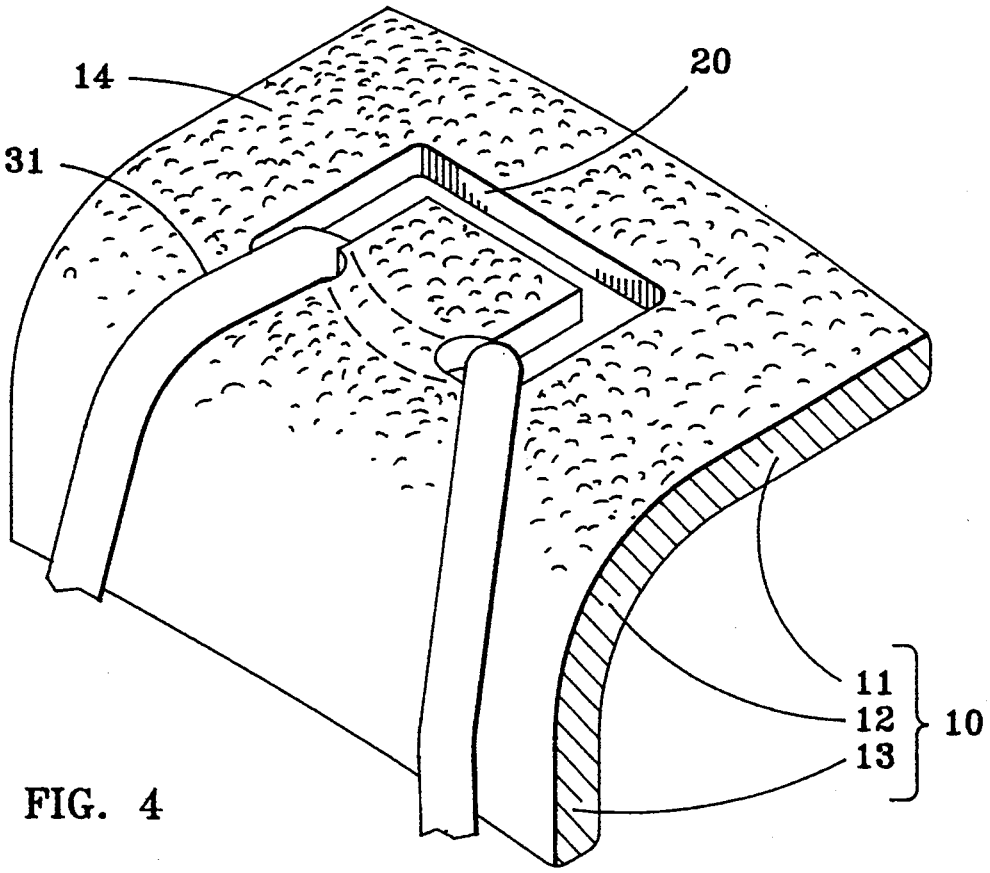
FIG. 4 is a fragmented perspective view of a section of the preferred embodiment of the flanged collar with a grainy, textured finish on the upper surface of the flange, and a U-shaped slot, illustrating the preferred method of attaching an attack-loop of the net to the slot as to a tab, hence traversing or lying down over the uniform radius or shoulder, hence hanging down within the collar and further connected to the lines of the net.

To those of ordinary skill in the art, the apparatus and methods of the present invention admit of variations.

As an example, the design size of the flanged collar can be varied to fit any size hoop or rim used in any game or activity wherein a netted hoop is required.

As another example: the net used in the net assembly can be any of a broad range of sizes and designs, of open or closed weave, open or closed-ended, and so on, as appropriate to the activity and the user's desire.

As a further example: The net attachment means can be varied to be any sort of slit, slot, tab, hole, button, tie, tie wrap, loop, pin, plug, or other means for simple, effective attachment of the net to the flange of the flanged collar.

As a yet further example: the upper surface texture can be varied by design or by modification to suit the type of ball being used and the activity involved.

As a still yet further example: the flanged collar may be designed or modified to accommodate other features such as the attachment of a practice grid to prevent the passage of balls through the rim, increasing the incidence of rebounds for practice.

As an illustration: any or all of the surfaces of the flanged collar likely to be in contact with the rim when the net assembly is in place may be configured or modified to include some degree of padding or application of slightly compressible, non-skid, resilient material or surface treatment, for the purpose of improving the stability and reducing any tendency to bounce or slide on the rim when contacted by a moving ball.

As a further illustration: The flanged collar may be fabricated from a variety of materials including metals and different plastics. The flanged collar may be molded, machined, or stamped or otherwise manufactured.

As a yet further illustration: the temporary closing of the net may be accomplished by a simple folding or rolling of the net so as to contain the ball or other carrying object from passing through the net prematurely, or before the net assembly has reached the rim.

The apparatus of the invention is a net assembly composed of three principal elements: a circular flanged collar, a net, and a means for temporarily closing the net. The methods of the invention pertain to the assembling of the net assembly, particularly to the attaching of the net to the flanged collar, and to the installation of the net assembly into position on the rim. The following is merely a description of the preferred embodiment of the apparatus and methodology of the invention.

The preferred embodiment of the circular flanged collar has a flanged portion, around the circumference of which are disposed a series of uniformally spaced slots for attaching a net. The inner diameter of the flange transitions downward via a uniform radius or shoulder, into a short collar of slightly smaller diameter. The flange is of a suitable size to sit atop a basketball rim. The collar is of a suitable size to fit easily within the mouth of the rim. The flanged collar is a one-piece unit molded of durable plastic. The slots in the flange are U-shaped, the open end of the U oriented towards the center of the flange.

The preferred embodiment of the net is simply a conventional nylon basketball net, commonly available at any sporting goods store. The preferred method of assembly has the attach-loops of the net attached from above the flange, hooked around the center of the U-shaped slot as to a tab, the net then being disposed down through the center of the collar so as to have the attach-loops traversing or lying over and being supported by the uniform radius or shoulder for stress relief, hence running down the inside wall of the collar and connecting to other lines of the net.

The preferred embodiment of means for temporarily closing the net is a simple clip, secured to one line of the net and clippable to other adjacent lines to close the net to easy passage of a basketball. The clip must be strong enough to withstand the weight of the net and the flanged collar with it is inverted and disposed over a supporting basketball in accordance with the preferred method for installing the net assembly. The clip must retain its grip while the ball and net assembly are thrown together up and onto the rim, the net assembly pulled and falling into place as the ball falls through the rim. The weight and force of the falling ball then disengages the clip, allowing the net to fall open and the ball to pass on through. The rim and net assembly is then functional in the same fashion as a rim with a net installed in the conventional manner.

Reference is now made to FIGS. 1, 2, 3, 4, 7, 10, 11, and 12 which illustrate pictorially the various elements of the preferred embodiment of the apparatus and methods of the invention.

Flanged collar 10 has a flange 11, around the circumference of which are disposed a plurality of uniformally spaced slots 20, for attaching attach-loops 31, of net 30. The inner diameter of flange 11 transitions downward, via a uniform radius 12, into collar 13. Flanged collar 10 optionally has grainy textured upper surface 14. Flange 11 is of a suitable size to sit atop basketball rim 50. Collar 13 is of a suitable size to fit easily within mouth of rim 50. Flanged collar 10 is a one-piece unit molded of durable plastic. A resilient, slightly compressible pad 15 is optionally adhered to the underside and around the circumference of flanged collar 10. Slots 20, in flange 11, are U-shaped, the open end oriented towards the center of flange 11.

Net 30 is simply a conventional nylon basketball net. Attach-loops 31 attach from above flange 11, around the center of U-shaped slots 20. Net 30 is then disposed down through the center of collar 13; attach-loops 31 traversing or lying over and being supported by the uniform radius 12 for stress relief, hence running down inside wall of collar 13, hence connecting to other lines 32 of net 30.

Clip 40, secured to one of lines 32, is clippable to other adjacent lines 32, closing net 30 to easy passage of basketball 60. Clip 40, is strong enough to withstand the weight of the net 30 and flanged collar 10, when inverted and disposed over supporting basketball 60. Clip 40 is strong enough to retain its grip while ball 60 is thrown up and onto rim 50; net 30 and flanged collar 10 being pulled and falling into place as ball 60 falls through rim 50. Weight and force of falling ball 60 then disengages clip 40, allowing net 30 to fall open and ball 60 to pass on through. For removal, ball 60 is thrown diagonally up through rim 50, striking and dislodging net 30 and flanged collar 10.

Figure 5:
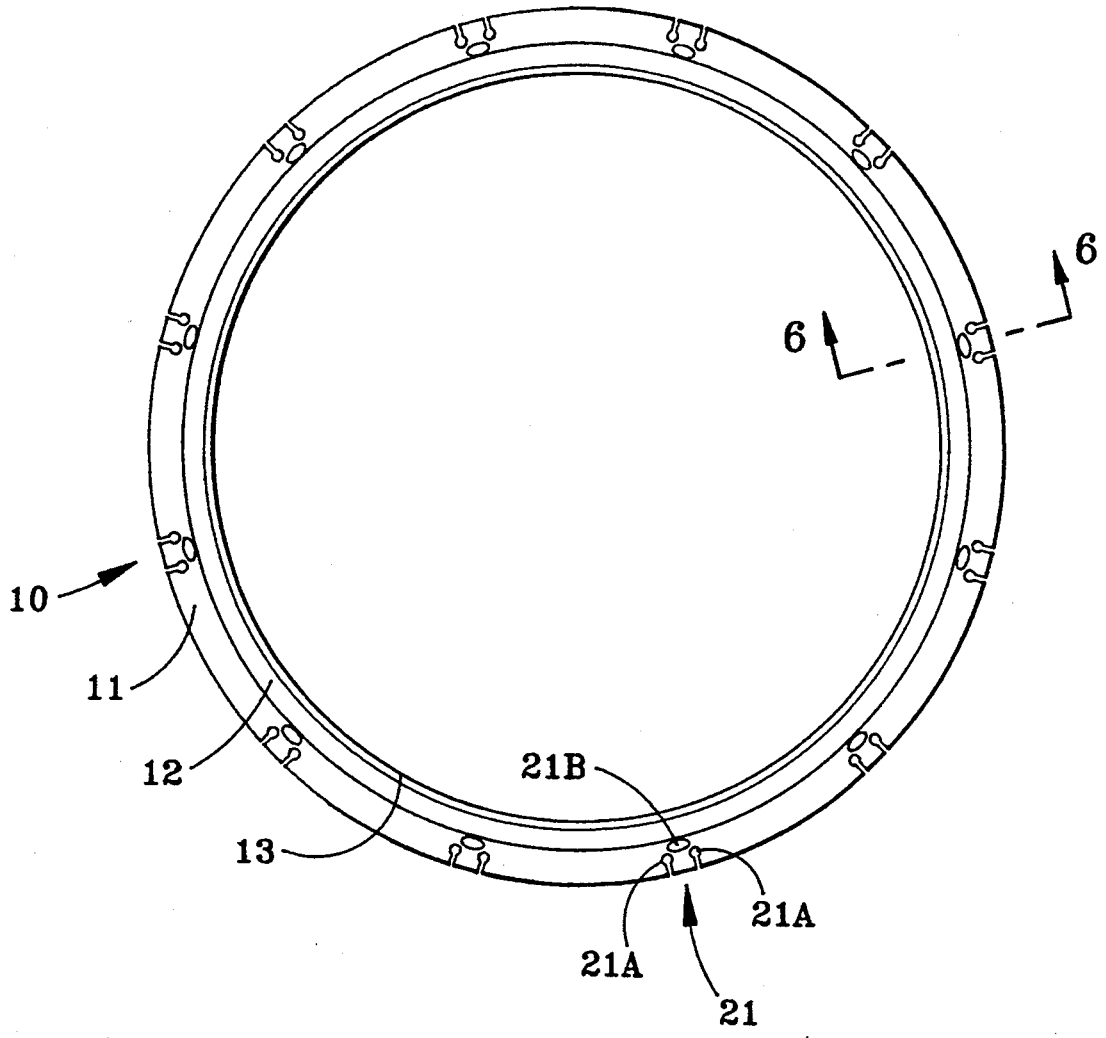
FIG. 5 is a top view of an embodiment of the flanged collar illustrating pair of slots and nearby holes uniformally spaced around the circumference of the flange to which attach-loops of the net will be attached.
Figure 6:
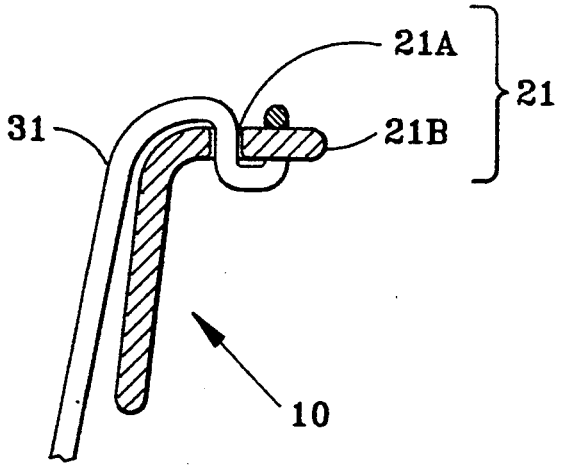
FIG. 6 is a partial cross-sectional view of the embodiment of the flanged collar of FIG. 5, illustrating the attach-loop running up the interior of the collar wall from the net, traversing the uniform radius or shoulder, up onto the flange, hence passing down through a hole and hence hooked to a pair of slots as to a tab.
Figure 7:
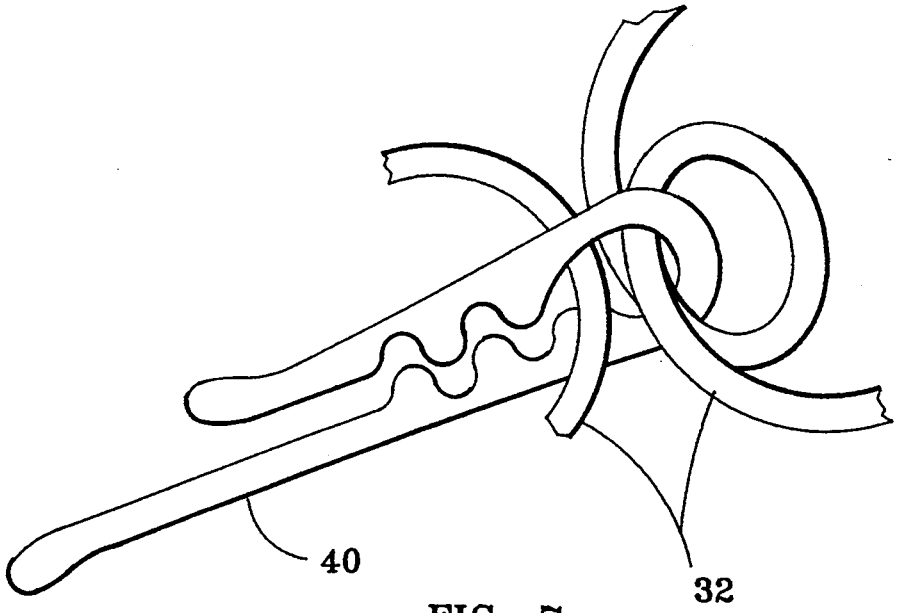
FIG. 7 is a fragmented perspective of a clip used for temporarily closing the net in accordance with the method of the invention for installing the net assembly, illustrating the clip secured to one line of the net and clipped to an adjacent line.

As depicted by FIGS. 5 and 6, uniformally dispersed pairs of slots 21A and co-located holes 21B together form attachment means 21, an alternative to slots 20 for securing attack-loops 31 of net 30 to flanged collar 10.

Figure 8:
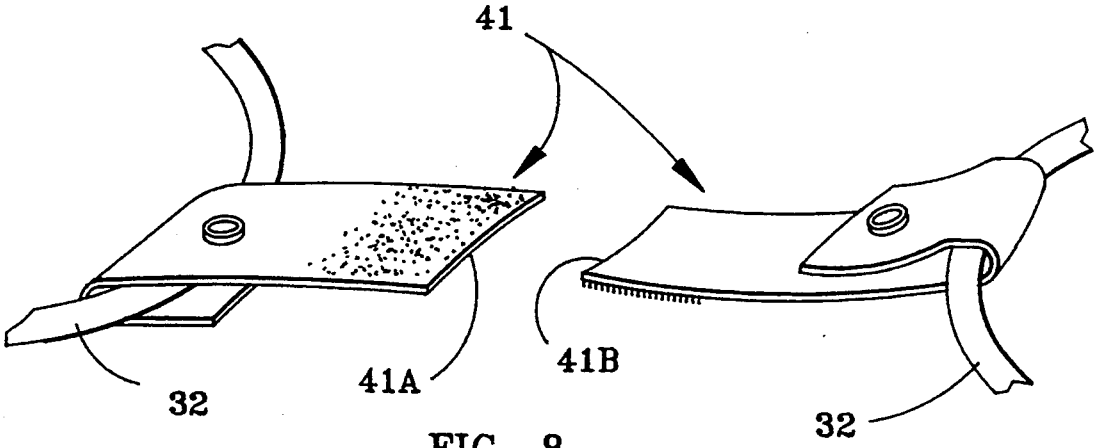
FIG. 8 is a fragmented perspective of VELCRO® brand or equivalent fastening tape mating tabs, used for temporarily closing the net in accordance with the method of the invention for installing the net assembly, illustrating the mating tabs, uncoupled, secured to lines of the net.
Figure 9:
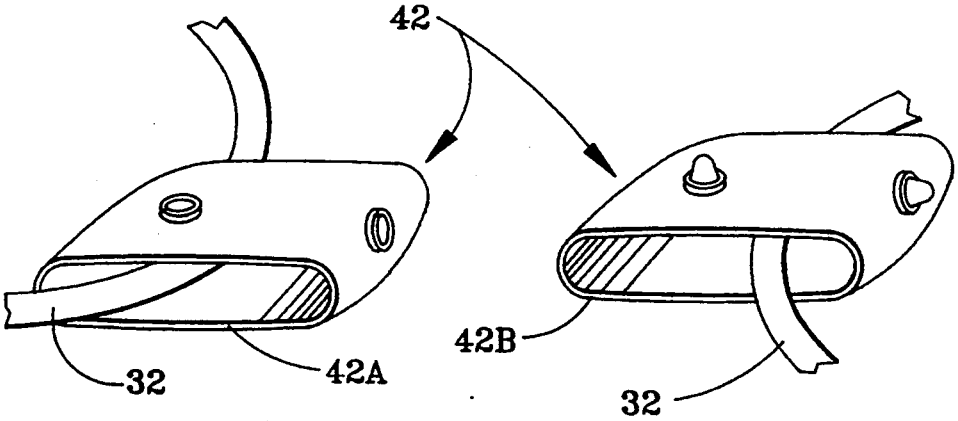
FIG. 9 is a fragmented perspective of mating snap tabs used for temporarily closing the net in accordance with the method of the invention for installing the net assembly, illustrating the mating tabs, uncoupled, secured to lines of the net.
Figure 10:
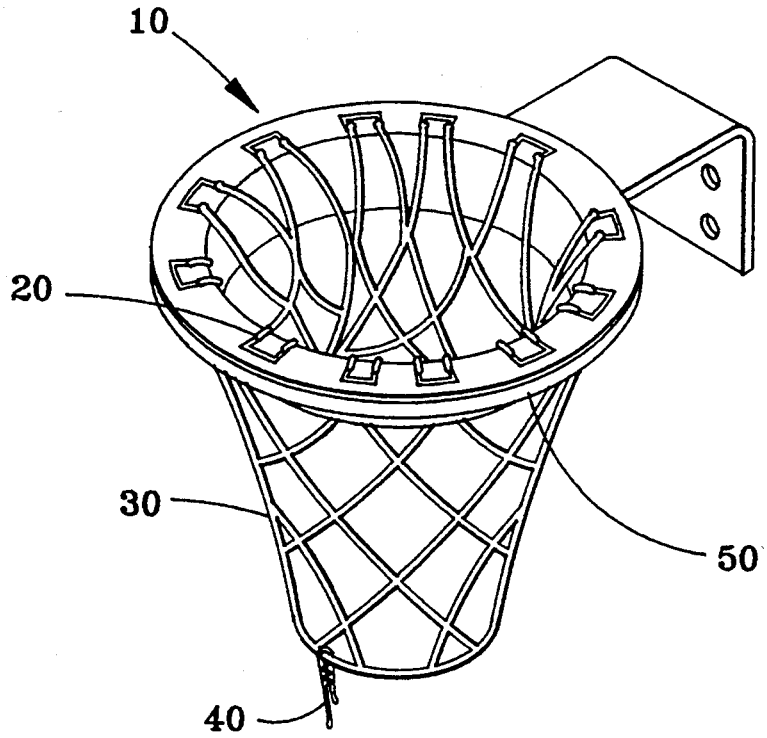
FIG. 10 is a perspective view of the net assembly installed on a basketball rim, illustrating the general relationship of the three principal parts of the net assembly as assembled and installed for its intended use.
Figure 11:
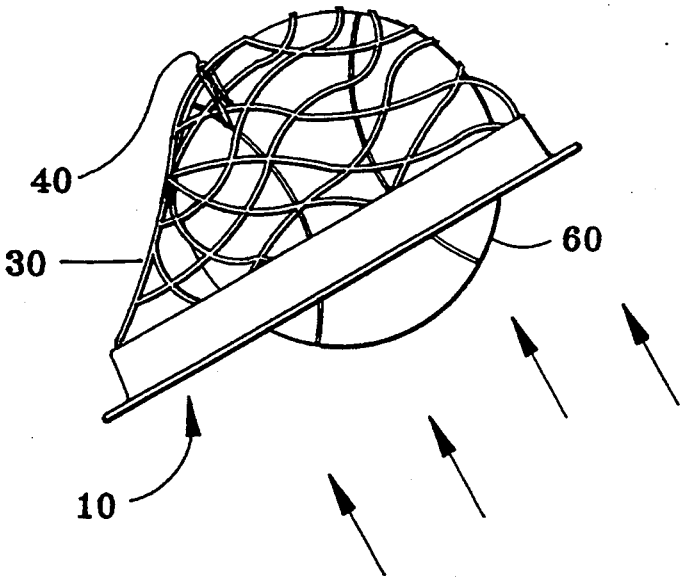
FIG. 11 is a side view of the net assembly and basketball being thrown up together, illustrating the method of the invention whereby the net is temporarily closed, the net assembly inverted and disposed over the supporting basketball, and the ball and net assembly thrown up to fall onto the rim, the net then opening under the weight and force of the falling ball.
Figure 12:
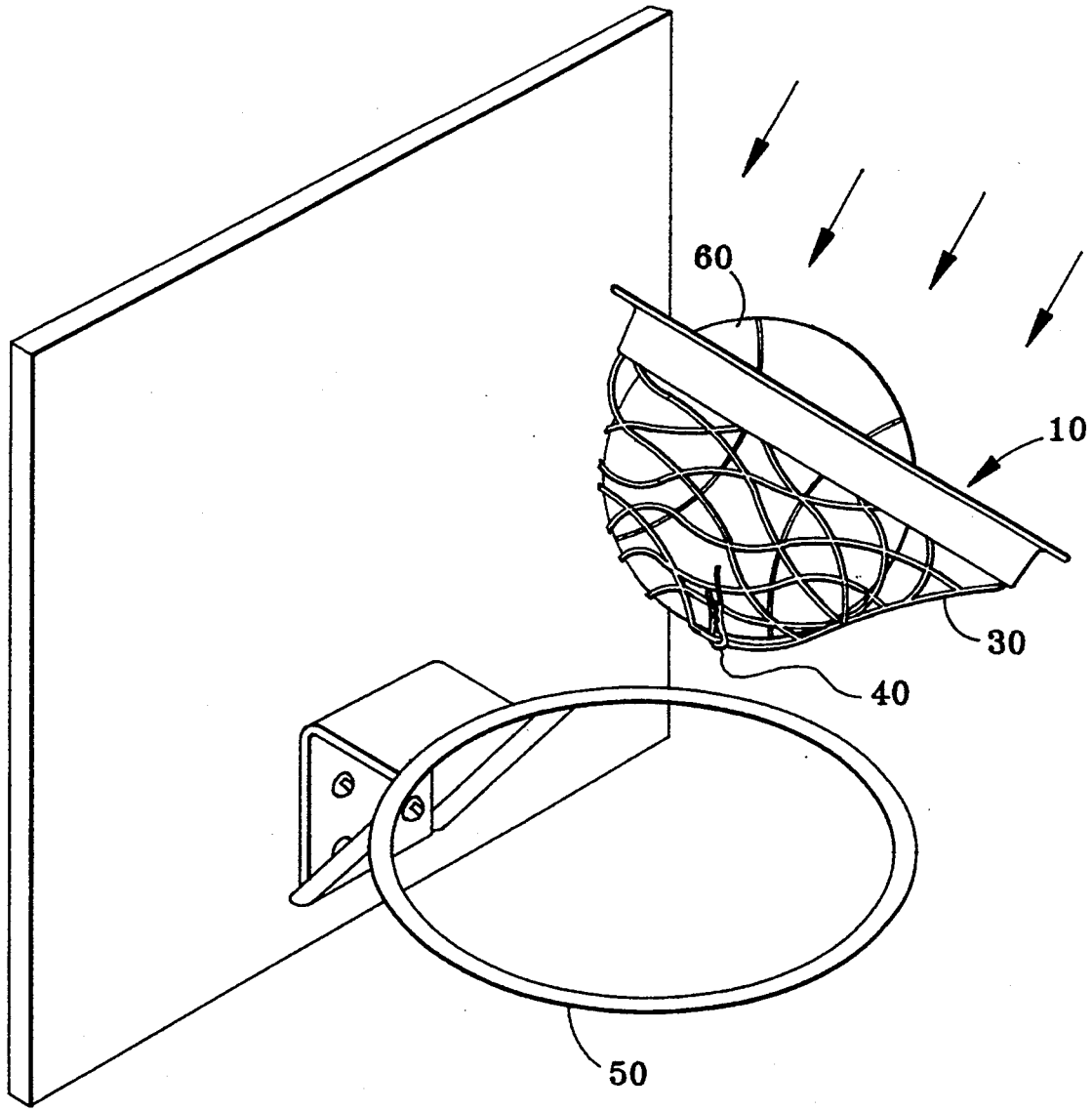
FIG. 12 is a side view of the net assembly and basketball falling towards the rim together, illustrating the method of the invention whereby the net is temporarily closed, the net assembly inverted and disposed over the supporting basketball, and the ball and net assembly thrown up to fall onto the rim, the net then opening under the weight and force of the falling ball.

Hook and eye fastner 41 of FIG. 8, comprised of hook material tab 41A secured to one of lines 32 and eye material tab 41B secured to another of lines 32, may be substituted for clip 40. Snap fastner 42 of FIG. 9, comprised of female snap component tab 42A secured to one of lines 32 and male snap component tab 42B secured to another of lines 32, may also be substituted for clip 40.

I claim:

1. A transportable basketball net assembly for use on a basketball rim, said net assembly comprising:

a circular flanged collar with a plurality of slots uniformally spaced around circumference and disposed on a flange of said flanged collar, inner diameter of said flange transitioning via a uniform radius downward into a short collar of slightly smaller diameter, said flange sized to rest on top of said rim, said collar sized to fit easily within mouth of said rim;

a basketball net, attach-loops of said net attached from above to said slots, said net disposed downward within said collar, said attach-loops of said net traversing and supported for strain relief by said uniform radius of said flanged collar, a small end of said net hanging open; and means for closing temporarily said small end of said net, said means being sufficiently strong to withstand weight of said net and said flanged collar when said net attached to said flanged collar is disposed inverted over a basketball and thrown up with said basketball into position on said rim, and insufficiently strong to withstand downward force and weight of falling said basketball when said flanged collar is lodged in said position and supported by said rim.

2. The transportable basketball net assembly of claim 1, wherein said slots comprise a pair of slits having an open end at an outer perimeter of said flange and each slit of said pairs of slits cooperating to form a tab to which each said attach-loops are attachable.

3. The transportable basketball net assembly of claim 1, each said slots being configured in a U-shape and each used as a tab to which said attach-loops are attachable.

4. The transportable basketball net assembly of claim 1, further comprising a plurality of holes in said flange each said hole disposed close to each said slot, each said attach-loops passing downward through one of said holes and hence to said closely disposed slots.

5. The transportable basketball net assembly of claim 4, wherein said flanged collar further comprising a grainy, textured finish on at least an upper surface of said flange.

6. The transportable basketball net assembly of claim 5, said flanged collar further comprising a resilient, slightly compressible pad affixed in at least one place on at least one surface selected from the group of surfaces consisting of a lower surface of said flange, an inner surface of said uniform radius and an outer surface of said collar.

7. The transportable basketball net assembly of claim 6, wherein said means for temporarily closing comprising at least one clip secured to at least one line of said net and clippable to at least one other line of said net.

8. The transportable basketball net assembly of claim 6, wherein said means for closing comprising at least one VELCRO ® brand of fastening tape tab secured to at least one line of said net and attachable to at least one other line of said net.

9. The transportable basketball net assembly of claim 6, wherein said means for temporarily closing comprising at least one snap tab secured to at least one line of said net and attachable to at least one other line of said net.

10. The transportable basketball net assembly of claim 1, wherein said flanged collar is molded and one-piece.

11. The transportable basketball net assembly of claim 1, wherein said flanged collar further comprising a grainy, textured finish on at least an upper surface of said flange.

12. The transportable basketball net assembly of claim 1, said flanged collar further comprising a resilient, slightly compressible pad affixed in at least one place on at least one surface selected from the group of surfaces consisting of a lower surface of said flange, an inner surface of said uniform radius and an outer surface of said collar.

13. The transportable basketball net assembly of claim 1, wherein said means for temporarily closing comprising at least one clip secured to at least one line of said net and clippable to at least one other line of said net.

14. The transportable basketball net assembly of claim 1, wherein said means for closing comprising at least one VELCRO ® brand of fastening tape tab secured to at least one line of said net and attachable to at least one other line of said net.

15. The transportable basketball net assembly of claim 1, wherein said means for temporarily closing comprising at least one snap tab secured to at least one line of said net and attachable to at least one other line of said net.

16. A method for assembling a transportable basketball net assembly for temporary installation and use on a basketball rim, said method comprising:

attaching of attach-loops of large end of a basketball net from above to a plurality of slots uniformally spaced around circumference and disposed on face of a flange of a flanged collar which inner diameter of said flange transitions via a uniform radius downward into a short collar of slightly smaller diameter, said flange sized to rest on top of said rim, said collar sized to fit easily within mouth of said rim, said net having means for closing temporarily of small end of said net, said means being of sufficient strength to withstand weight of said net and said flanged collar when said net attached to said flanged collar is inverted and disposed over said basketball and thrown up with said basketball into position on said rim, and of insufficient strength to withstand downward force and weight of falling said basketball when said flanged collar is lodged in said position and supported by said rim;

disposing of said net downward within said collar; and arranging of said attach-loops to traverse and be supported for strain relief by said uniform radius, lower end of said net thus hanging open.

17. The method of claim 16, said attaching of attach-loops to said slots further comprising: said slots being disposed in pairs and open at outer perimeter of said flange, said pairs of said slots used as tabs to which said attach-loops are attachable.

18. The method of claim 16, said attaching of attach-loops to said slots further comprising: each said slots being configured in a U-shape and used as a tab to which said attach-loops are attachable.

19. A method for installing a basketball net on a basketball rim, said method comprising:

attaching of attach-loops of said basketball net to a flanged collar, flange of said flanged collar sized to rest on top of said rim, collar of said flanged collar sized to fit easily within mouth of said rim;

closing temporarily of said small end of said net by means of sufficient strength to withstand weight of said net and said flanged collar when said net attached to said flanged collar is inverted and disposed over a basketball and thrown up with said basketball into position on said basketball rim, and of insufficient strength to withstand downward force and weight of falling said basketball when said flanged collar is lodged in said position and supported by said rim;

inverting and disposing of said net attached to said flanged collar over said basketball;

throwing of said basketball up from outside said rim so as to fall down through said rim, thereby depositing said flanged collar and said net into position on said rim, said means of sufficient strength releasing under said downward force and weight of said basketball, thus opening said net.

20. The method of claim 19, further comprising the step of clipping at least one clip secured to at least one line of lines of said net to at least one other line of said net said means of sufficient strength being each said at least one clip.

* * * * *